US009613775B2

(12) United States Patent
Ebi et al.

(10) Patent No.: US 9,613,775 B2
(45) Date of Patent: Apr. 4, 2017

(54) BLADE FUSE

(71) Applicant: Pacific Engineering Corporation, Ogaki-shi (JP)

(72) Inventors: Masashi Ebi, Ogaki (JP); Daiji Kondo, Ogaki (JP)

(73) Assignee: PACIFIC ENGINEERING CORPORATION, Ogaki-shi (JP)

( * ) Notice: Subject to any disclaimer, the term of this patent is extended or adjusted under 35 U.S.C. 154(b) by 4 days.

(21) Appl. No.: 14/762,726

(22) PCT Filed: Jan. 29, 2014

(86) PCT No.: PCT/JP2014/000436
§ 371 (c)(1),
(2) Date: Jul. 22, 2015

(87) PCT Pub. No.: WO2014/122899
PCT Pub. Date: Aug. 14, 2014

(65) Prior Publication Data

US 2015/0371802 A1 Dec. 24, 2015

(30) Foreign Application Priority Data

Feb. 5, 2013 (JP) ..... 2013-020354

(51) Int. Cl.
*H01H 85/08* (2006.01)
*H01H 85/041* (2006.01)
(Continued)

(52) U.S. Cl.
CPC ..... *H01H 85/08* (2013.01); *H01H 85/041* (2013.01); *H01H 85/0417* (2013.01);
(Continued)

(58) Field of Classification Search
CPC .... H01H 85/10; H01H 85/11; H01H 85/0417; H01H 85/041; H01H 85/08; H01H 85/147
(Continued)

(56) References Cited

U.S. PATENT DOCUMENTS 4,357,588 A * 11/1982 Leach ..... H01H 85/055 337/160
4,625,195 A * 11/1986 Robbins ..... H01H 85/42 337/159
(Continued)

FOREIGN PATENT DOCUMENTS

JP 2005-93168 A 4/2005
JP 2008-21488 A 1/2008
(Continued)

OTHER PUBLICATIONS

Original and English translation of International Search Report for PCT/JP2014/000436 mailed on Feb. 25, 2014 (5 pages).

*Primary Examiner* — Anatoly Vortman
(74) *Attorney, Agent, or Firm* — Shumaker, Loop & Kendrick, LLP

(57) ABSTRACT

Disclosed is a highly durable blade fuse for which a fused site in a narrow section and the rated current are determined in conformity with its design and the temperature of which does not increase greatly when a current flows through it. A blade fuse according to the present invention includes terminal sections (A, B) and a connection section (1), which are made of the same metal base material that is zinc or a zinc alloy. Furthermore, a low-melting-point metal piece (3), made of tin, which has an outer size identical or similar to a width of the connection section (1) is melted and stuck on at least one surface of the connection section (1) outside the fused section (2), and is positioned to partially traverse an
(Continued)

edge of the fused section (2) or not to traverse the edge but to be adjacent to the edge.

6 Claims, 14 Drawing Sheets

(51) Int. Cl.
*H01H 85/10* (2006.01)
*H01H 85/11* (2006.01)
*H01H 85/147* (2006.01)

(52) U.S. Cl.
CPC ..... *H01H 85/10* (2013.01); *H01H 85/11* (2013.01); *H01H 85/147* (2013.01)

(58) Field of Classification Search
USPC ..... 337/296
See application file for complete search history.

(56) References Cited

U.S. PATENT DOCUMENTS 4,944,084 A * 7/1990 Horibe ..... H01H 85/06 29/623
5,262,751 A * 11/1993 Kudo ..... H01H 85/06 337/160
5,398,015 A * 3/1995 Kudo ..... H01H 85/0417 337/255
5,528,213 A * 6/1996 Kondo ..... H01H 85/10 337/160
5,668,521 A * 9/1997 Oh ..... H01C 1/1406 337/186
5,668,522 A * 9/1997 Kondo ..... H01H 85/0417 337/160
5,739,741 A * 4/1998 Hanazaki ..... H01H 85/11 337/160
5,745,023 A * 4/1998 Totsuka ..... H01H 85/0417 337/160
5,748,067 A * 5/1998 Ishii ..... H01H 85/0417 337/152
5,821,847 A * 10/1998 Totsuka ..... H01H 85/11 29/623
5,883,560 A * 3/1999 Nakamura ..... H01H 85/11 337/152
5,883,562 A * 3/1999 Matsuoka ..... H01H 85/165 337/227
6,243,245 B1 * 6/2001 Totsuka ..... H01H 85/46 361/103
6,590,490 B2 * 7/2003 Ackermann ..... H01H 85/0056 337/142
9,111,708 B2 * 8/2015 Onoda ..... H01H 85/10
2002/0008608 A1 * 1/2002 Brown ..... H01H 85/11 337/290
2010/0315192 A1 * 12/2010 Onoda ..... H01H 85/10 337/163
2014/0035717 A1 * 2/2014 Nomura ..... H01H 85/153 337/186

FOREIGN PATENT DOCUMENTS

JP 2008-243757 A 10/2008
JP 2009-99372 A 5/2009
JP 2010-67475 A 3/2010

* cited by examiner

Evaluation of migration effect from comparison of fusing times 5A blade fuse (five samples for each load)

| Load (rated ratio %) | Terminal section A of positive pole (fused section of positive pole) | | | Terminal section B of positive pole (fused section of negative pole) | | |
|---|---|---|---|---|---|---|
| | MAX | MIN | AVE | MAX | MIN | AVE |
| 135 | 152 | 74 | 102 | 162 | 89 | 133 |
| 130 | 239 | 159 | 202 | 597 | 315 | 417 |
| 128 | 323 | 198 | 243 | 643 | 461 | 552 |
| 126 | 473 | 204 | 354 | 881 | 649 | 738 |
| 124 | 625 | 431 | 527 | 1829 | 792 | 1161 |
| 122 | 1005 | 711 | 849 | 2283 | 1441 | 1803 |
| 120 | 1460 | 1226 | 1331 | No blowing over 500 hours | | |
| 118 | 2401 | 1385 | 1829 | | | |
| 116 | No blowing over 500 hours | | | | | |

FIG. 9

BLADE FUSE

TECHNICAL FIELD

The present invention relates to a blade fuse for use in protecting an electric circuit in, for example, an automobile. More specifically, the present invention relates to a highly durable in-vehicle blade fuse which is used within a relatively low current region in which a rated current is 30 A or below and the temperature of which does not increase greatly when a current flows therethrough.

BACKGROUND ART

A blade fuse is a protection element that interrupts an electric circuit promptly when an unexpected high current flows through it. Such blade fuses are now applicable to many fields.

As is known in the automobile field, for example, many fuses are used in a single automobile. The recent development of high-density mounting of electric circuit components has boosted a demand for the compactness of fuses to be mounted. In addition, an increasing number of fuses have been mounted.

However, on the contrary, a space allocated to a fuse box and the like has been increasingly narrowed. In such a case, when a normal current flows through a fuse box, many fuses therein emit heat from their fused sections, and this heat may shorten the lifetime. In addition, the heat is transmitted to an adjacent electric circuit through the terminal sections of the fuses, so that the electric circuit is heated over an extended period of time, which may cause the melting of the casing, the malfunction of the electric circuit, or eventually burnout of the circuit.

Accordingly, nowadays, the emergence of highly durable blade fuses in which a casing is not scorched within a normal, actually in-use current region is demanded. Those fuses have a fixed blown site, and their temperature does not increase greatly when currents flow through them.

There are some existing fuses adapted for the above application. A fuse of this type is interconnected at both terminal ends with a connection section, made of copper (melting point of 1050° C.) or a copper alloy, and its substantially central section is provided with a fused section (also referred to as a "narrow section") having the smallest cross section. Furthermore, a low-melting-point metal piece, made of tin (melting point of 230° C.), silver, or the like, which is formed into a claw shape that rises above surrounding connection sections while surrounding the narrow section is swaged and fixed to an upper portion of the narrow section (e.g., Patent Documents 1 and 2).

The reason for fixing the low-melting-point metal piece to the narrow section is to promptly break and separate the narrow section as follows. When an overcurrent flows through the narrow section, the low-melting-point metal piece is melted. Then, the melted low-melting-point metal piece is diffused inside the base copper texture, creating a copper-tin alloy. In this alloy area, the melting point is lowered.

Unfortunately, if a metal bonding method by which a low-melting-point metal piece (made of zinc or zinc alloy) is fixed directly to an upper portion of a narrow section by means of, for example, swaging and is applied to a blade fuse for automobiles used in a relatively low rated current region in which a rated current is 30 A or below, a problem arises in that its rated current, fused site, and fused current cannot be controlled easily. The reason being is that the blade fuse is very sensitive to, for example, an oxide film formed between the metals or a trace quantity of dust, the rated current, fused location, and fused current becomes unstable.

Some fuses known in the art each include: a narrow section in which nothing is provided; and a rivet-shaped tin alloy having a low melting point which is fixed on both sides of the narrow section (e.g., Patent Document 3). These fuses are, however, intended for a high capacity field in which a rated current is 55 A. Furthermore, the length of the narrow section is 0.85 mm, but the distance between the narrow section and rivet-shaped tin is 3.81 mm. Thus, they are apart from each other by at least fourth times the length of the narrow section. This structure may prolong the time until the narrow section is blown and its temperature does not decrease easily when a current flows through it.

Patent Document 1: JP 2008-21488 A (claim 1, and a part indicated by reference sign 14 in FIG. 2)

Patent Document 2: JP 2745190 B1 (a part indicated by reference sign 110 in FIG. 8)

Patent Document 3: JP 7-31976 B (line 33 in column 10 to line 21 in column 11, and FIG. 5)

SUMMARY OF THE INVENTION

The present invention addresses the above problems by providing a highly durable blade fuse in which a fused site has a narrow section and a rated current determined to be in conformity with its design such that temperature does not greatly increase when a current flows therethrough.

A blade fuse of the present invention which addresses the above problems includes a pair of terminal sections positioned at both ends. The terminal sections are interconnected with a connection section formed of a fusible metal body. On a substantially central section of the connection section, a fused section that is smaller in cross section than the connection section is formed. The terminal sections and the connection section are made of the same metal base material that is zinc or a zinc alloy. A low-melting-point metal piece, the outer size of which is identical or similar to the width of the connection section, is melted and stuck on at least one surface of the connection section outside the fused section, and is positioned to partially traverse an edge of the fused section or not to traverse but to be adjacent to the edge (referred to below as a "first invention").

The low-melting-point metal piece is made of, for example, tin, silver, lead, nickel, or an alloy thereof.

The present invention is characterized in that the low-melting-point metal piece is formed at the above predetermined site as opposed to existing fuses. A reason for this will be described below.

A narrow section is a part in which the current density is maximized, because it is formed so as to have the smallest cross section across the blade fuse. In light of the design of the rated current and other fusing characteristics, this part should be broken and separated. Therefore, it is preferable that nothing be basically provided in the narrow section.

The low-melting-point metal piece needs to be formed outside and adjacent to the narrow section. If the low-melting-point metal piece is formed far away from the narrow section, the property of the low-melting-point metal piece fails to influence the narrow section. The present inventors have conducted many experiments and, as a result, have found the fact that forming "the low-melting-point metal piece on at least one surface of the connection section outside the fused section so that it partially traverses an edge of the fused section or does not traverse but is adjacent to the edge," as described above, produces significant effects.

Both the low-melting-point metal piece formed at the predetermined site and an electromigration effect that will be described with reference to FIG. 4(*a*) enable the narrow section to be broken and separated promptly. In addition, they can reduce the temperature rise that would be caused by the narrow section, within a non-fusing current region before the breakage (in which the maximum current that does not blow the narrow section continuously flows and the current feeding proportion ranges from about 120 to 130% in terms of a rated current ratio).

If the low-melting-point metal piece is formed so as to "partially traverse an edge of the fused section," the narrow section is broken and separated easily and promptly while the above fusing property of the narrow section is effectively maintained.

The outer size of the low-melting-point metal piece formed thus only has to be identical or similar to the width of the connection section.

In association with a method of melting and sticking the low-melting-point metal piece on the connection section which is employed in the present invention and will be described below in detail, in many cases, a specific shape of the low-melting-point metal piece formed on the surface of the connection section is an "inverted bowl shape" as seen from the front, which seems like a bowl placed upside down on the surface of the connection section. However, it is not limited to an inverted bowl shape and may be, for example, a circular, elliptical, or a long-hole shape in a planar view.

A method of fixing the low-melting-point metal piece to the connection section needs to be a "melting and sticking method." If the low-melting-point metal piece is larger in size than required, it absorbs heat when melted and stuck due to its high heat capacity. If a method of fixing the low-melting-point metal piece to the connection section is a metal bonding method as in Patent Document 1 or 2, the influence of an oxide film, dust, and the like present therebetween becomes an obstacle to the electromigration effect.

The term "electromigration" recited herein is a phenomenon in which electrons and metal atoms moving in an electro-conductive material exchange their momentums with each other, causing a gradual movement of ions and a defective shape of the material. This effect is enhanced as the current density increases. The effect thus influences a finer integrated circuit more prominently (refer to Wikipedia, the free encyclopedia). Herein, the "electromigration" is also referred to as "migration."

Further, the above low-melting-point metal piece is preferably melted and stuck on the rear or/and side surface of the connection section at a substantially symmetric site with respect to the center of the fused section (referred to below as a "second invention").

This is because melting and sticking the low-melting-point metal piece on both the front and rear surfaces or/and side surface of the connection section at a substantially symmetric site with respect to the center of the fused section can further reduce a variation in the migration effect.

The above fused section may have any given shape. For example, a long hole that extends along the length of the connection section may be formed in the substantially central section of the connection section. Then, the region in which the long hole decreases the cross section of the substantially central section of the connection section may be used, instead of the fused section that is smaller in cross section than the connection section (referred to below as a "third invention").

Although the blade fuse of the present invention can be used for various applications, it is suitable especially for an in-vehicle application, such as an automobile application (referred to below as a "fourth invention").

The blade fuse according to the first invention produces the following effects.

(1) The terminal sections positioned at both ends are interconnected with the connection section formed of a fusible metal body. The fused section, or the narrow section, is formed in the substantially central section of the connection section. The low-melting-point metal piece is melted and stuck on a site that partially traverses an edge of the fused section or does not traverse but is adjacent to the edge. According to this configuration, the suppressing effect of the temperature rise by the low-melting-point metal piece and the enhanced durability can be expected.

The configuration described above can stabilize the above effects and reduce a variation in the fusing property of the low-melting-point metal piece.

(2) The low-melting-point metal piece, which is melted and stuck on at least one surface of the connection section outside the fused section and is positioned to partially traverse an edge of the fused section or not to traverse but to be adjacent to the edge, has an outer size identical or similar to the width of the connection section. This configuration can make the migration effect emerge effectively. More specifically, the configuration causes the fused section to be broken and separated promptly at a current and at a fused site that conform to those of its initial design, independently of external factors.

(3) As a result, the temperature rise is reduced when a current flows through the blade fuse, and the durability of the fuse is thereby enhanced. This configuration makes it possible to create a design such that a wire in an electric circuit to which the blade fuse of the present invention is connected has a small diameter, contributing to a reduction in overall costs.

According to the blade fuse of the second invention, the low-melting-point metal piece is further melted and stuck on the rear or/and side surface of the connection section at a substantially symmetric site with respect to the center of the fused section. This configuration can reduce a variation in the migration effect.

According to the blade fuse of the third invention, a long hole that extends along the length of the connection section is formed in the substantially central section of the connection section, and forming the long hole decreases the cross section of the substantially central section of the connection section. This configuration enables a fused section to be formed so as to have a desired narrow cross section.

According to the blade fuse of the fourth invention, it is possible to provide a blade fuse that is adapted for high-density mounting of electric circuit components when any of the above blade fuses is used for an in-vehicle application.

BRIEF DESCRIPTION OF THE DRAWINGS

FIG. 1(*b*) is a side view of the blade fuse in FIG. 1(*a*).

FIG. 2(*b*) is a schematic view used to explain the fused section in FIG. 2(*a*) and an enlarged, vertical cross-sectional view of the fused section.

FIGS. 3(*c*) and 3(*d*) are vertical cross-sectional views illustrating an example of the contact part between the connection section and the low-melting-point metal piece in any of FIGS. 1(*a*) to 3(*b*).

FIG. 6(*b*) is a table of the comparison between the resistances of blade fuses of the present invention and mass production, both of which have a rated current of 15 A. FIG. 6(*c*) is a table of the comparison between the resistances of blade fuses of the present invention and mass production, both of which have a rated current of 30 A.

FIG. 8(*b*) is a side view of the blade fuse in FIG. 8(*a*).

FIG. 9 is a table showing an effect of the blade fuse according to embodiment 2 of the present invention.

EMBODIMENTS OF THE INVENTION

One embodiment of the present invention will be described below or the basis of FIGS. 1 to 9.

Example 1

This embodiment is an exemplary blade fuse (a fuse equivalent to that in ISO 8820) that has a rated current of 10 A to 30 A and thus pertains to a relatively low rated current region.

<Configuration of Blade Fuse of the Present Invention>

Figure 1B:
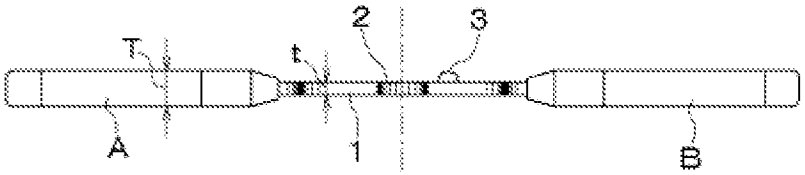
FIG. 1(*a*) is a plan view of an entire blade fuse according to one example of the present invention.
Figure 1A:
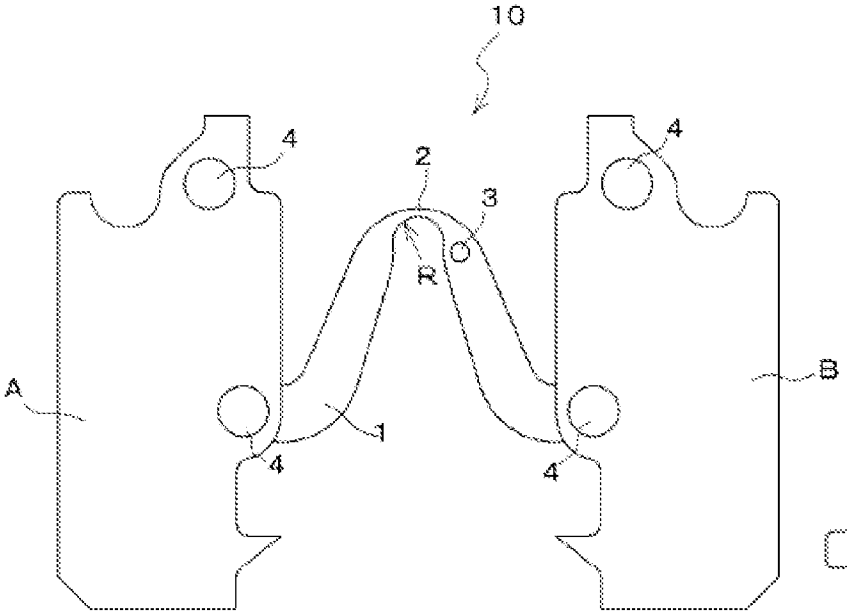

FIG. 1(*a*) is a plan view of an entire blade fuse 10 according to one example of the present invention. FIG. 1(*b*) is a side view of the blade fuse 10 in FIG. 1(*a*).

In FIG. 1(*a*), a blade fuse 10 of the present invention includes: a pair of terminal sections A and B: a connection section 1 that connects both the terminal sections A and B; a fused section 2 that is positioned in the substantially central section of the connection section 1 and has the smallest cross section across the connection section 1; and a granular low-melting-point metal piece 3 melted and stuck to a site in the vicinity of the fused section 2.

Both the terminal sections A and B, each of which has a blade-shaped outline, are arranged in parallel and at a predetermined spacing. In the upper portion of each terminal section, an engaging hole 4 by which the terminal sections are engaged with a casing (not illustrated) is provided.

The connection section 1 is formed, on a whole, into a substantially fan shape in a planar view with press molding. As illustrated in FIG. 1(*b*), a thickness t of the connection section 1 is formed so as to be smaller than a thickness T of the terminal sections A and B.

As illustrated in FIG. 1(*a*), the substantially central section of the connection section 1 has an inner side further rounded into an incurved shape with a radius R, so that the fused section 2 is formed therein as a narrow section having the smallest cross section. The terminal sections A and B and the connection section 1 are typically made of the same metal base material, such as zinc or a zinc alloy.

Figure 2B:
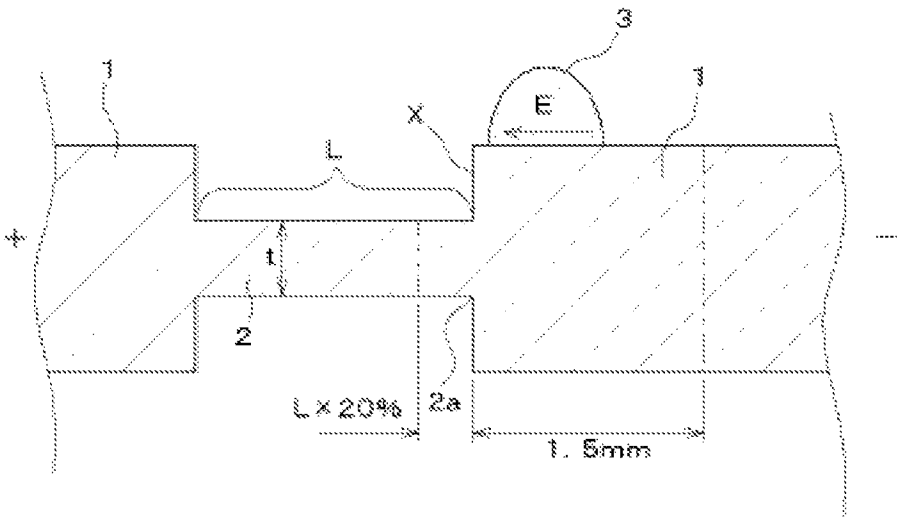
FIG. 2(*a*) is a partially enlarged view of the fused section (narrow section) of the blade fuse in FIG. 1(*a*).
Figure 2A:
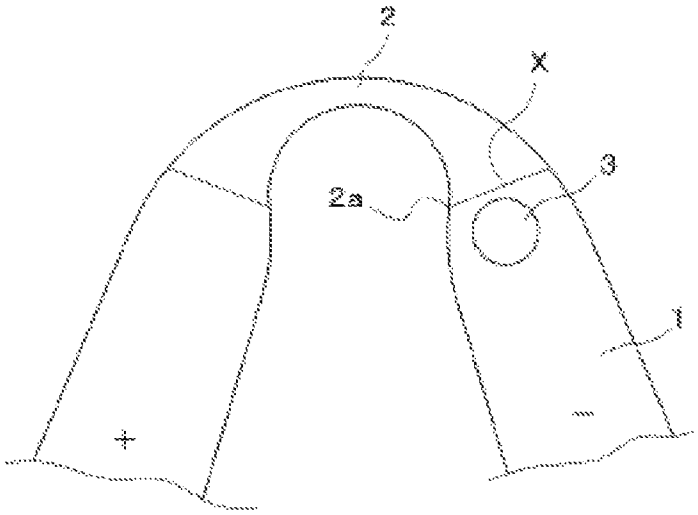
Figure 3B:
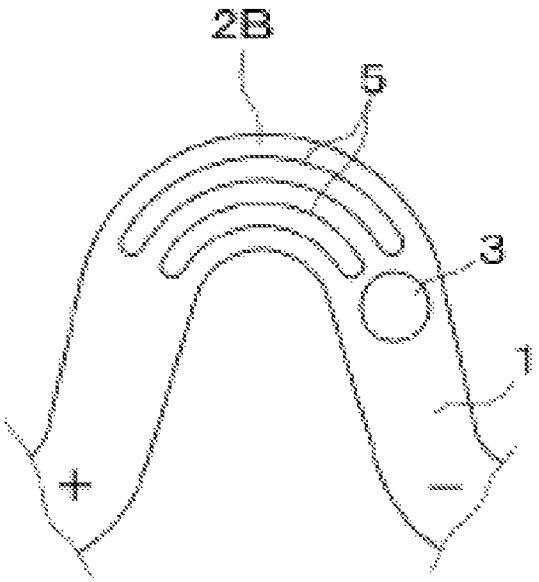
FIGS. 3(*a*) and 3(*b*) illustrate other examples of the fused section in FIG. 2(*a*).
Figure 3A:
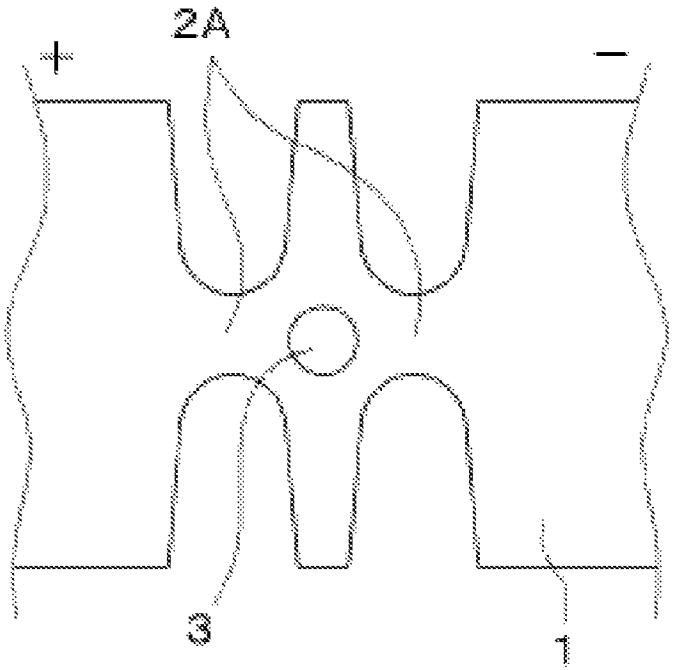
Figure 3D:
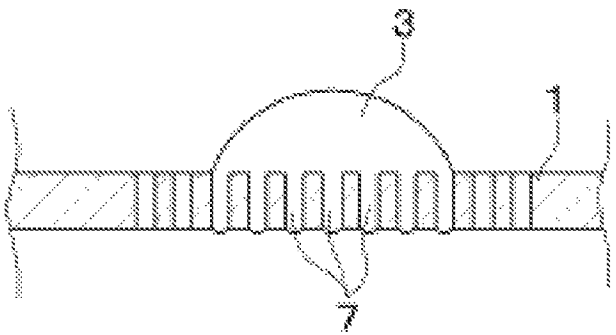
Figure 3C:
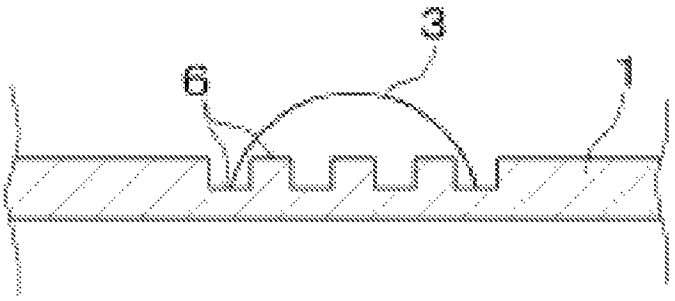

FIG. 2 are views illustrating the detail of the fused section 2 in FIG. 1. More specifically, FIG. 2(*a*) is a partially enlarged view of the fused section 2 (narrow section); FIG. 2(*b*) is an enlarged, vertical cross-sectional view of the fused section 2 in FIG. 2(*a*). In FIG. 2(*b*), to exaggerate the fact that the fused section 2 is the narrow section, its thickness t is smaller than the thickness of the fused section 2 in FIG. 2(*a*).

As illustrated in FIG. 2(*a*), the low-melting-point metal piece 3 is melted and stuck to the flat surface of the connection section 1 on the negative side as seen from the fused section 2 by a method that will be described later. This low-melting-point metal piece 3 is made of, for example, tin (Sn), silver (Ag), or nickel. What is important to make an effect of the present invention emerge is that the low-melting-point metal piece 3, which is positioned on a surface of the connection section 1 outside the fused section 2 as described above, partially traverses an edge 2*a* of the fused section 2 or does not traverse but is adjacent to the edge 2*a*.

More specifically, as illustrated in FIG. 2(*b*), assuming that the length of the fused section 2 in a direction of the terminal sections A and B is denoted by L, what is important is that the low-melting-point metal piece 3 is melted and stuck at a first site or a second site. The first site is positioned within an inner area stretching inwardly from a negative-side border X of the fused section 2 by 0.20 L; this inner area partially traverses the edge 2*a* of the fused section 2. The second site (the site in FIG. 2(*b*)) is positioned within an outer area stretching by 1.5 mm in the direction from the negative-side border X of the fused section 2 to the connection section 1; this outer area does not traverse the edge 2*a* but is adjacent to it.

If the low-melting-point metal piece 3 is formed more than 0.20 L away from the negative-side border toward the positive side, the entire fusing property may vary more greatly depending on the distance from the negative-side border or the size of the low-melting-point metal piece. In general, the fusing time tends to be prolonged.

If the low-melting-point metal piece 3 is formed more than 1.5 mm away from the negative-side border of the fused section 2 toward the negative side, the site at which the effect emerges is shifted from the narrow section to the connection section which is wider. In this case, the fusing property may vary more greatly within the light load range (i.e., the fusing time is prolonged within the light load range). Consequently, the migration effect that strongly influences the effect of the present invention does not emerge significantly, failing to fulfill the expectation that the temperature of the blade fuse does not increase greatly when a current flows through it and the durability thereof improves.

Although the site at which the low-melting-point metal piece 3 is formed may be positioned on either the positive side or negative side as seen from the fused section 2, it is preferably positioned on the negative side. A reason for this will be described later with reference to FIG. 9.

Next, a description will be given below of a method of forming the low-melting-point metal piece 3 in the connection section 1.

The cylinder of a ceramic heater (not illustrated) is heated to 400 to 600° C., and then is moved to the surface of the connection section 1 close to the fused section 2 and stopped there.

A flux-containing thread solder, made of tin, having a diameter of 0.4 mm is partially cut, and the cut piece is dropped into the cylinder from the above. After dropped into the cylinder, the thread solder piece is heated and melted. Then, it is stuck to the surface of the connection section 1 at a predetermined site. In this case, changing the length of the cut piece of the thread solder can adjust the stuck quantity of tin. By dropping the thread solder to the surface of the connection section 1 from the above in this manner, tin on the connection section 1 is formed into a circular outer shape in a planar view as illustrated in FIG. 2(*a*) and into an inverted bowl shape in a cross-sectional view which seems like a bowl placed upside down on the connection section 1 as illustrated in FIG. 2(*b*). In the example illustrated in the drawing, the low-melting-point metal piece 3 is melted and stuck such that its outer extension is positioned on the border between the fused section 2 and the connection section 1. In this case, using a known position adjusting apparatus can control accurately and easily the location of the low-melting-point metal piece 3 so that it stuck at the predetermined site.

The present inventors have proved that when tin is melted and stuck on the connection section 1 in the blade fuse 10 having a rated current of 10 A by the above method, the longest vertical distance between the low-melting-point metal piece 3 having an inverted bowl shape and the surface of the narrow section is preferably set to 0.15 mm or above.

If the distance is set to less than 0.15 mm, the melting of the base material into the low-melting-point metal piece may be reduced or the migration effect may be mitigated, thereby failing to produce the intended effect of the present invention.

The quantity of the low-melting-point metal piece 3 applied is preferably in the range from 0.3 to 1.2 mg inclusive. The application quantity of less than 0.3 mg may result in the reduction in the melting of the base material or the mitigation of the migration effect. The application quantity of more than 1.2 mg may result in an excessive influence that the low-melting-point metal piece exerts as a conductive material, producing an adverse effect. Neither of both cases is preferable.

The shape of the fused section 2 of the present invention is not limited to a substantially fan shape as illustrated in FIGS. 1 and 2. For example, the fused section 2 may employ a shape as illustrated in FIGS. 3(*a*) and 3(*b*) or some other shape.

In the example illustrated in FIG. 3(*a*), a fused section 2A has four slits, two pairs of which oppose each other across the center, and narrow sections are thereby formed between the slits. The low-melting-point metal piece 3 is positioned at the center so as not to cause a polarity difference of the migration, and the narrow sections are left on both sides of the low-melting-point metal piece 3.

In the example illustrated in FIG. 3(*b*), a fused section 2B has two rows of long holes 5 extending across the substantially central section of a connection section in a direction of terminal sections A and B. Due to this, narrow sections are formed at the locations of the long holes 5. In these drawings, the reference sign 3 indicates the melted and stuck low-melting-point metal piece.

As illustrated in FIGS. 3(*c*) and 3(*d*), the low-melting-point metal piece 3 is preferably melted and stuck to the surface of the connection section 1 which is subjected to an uneven processing 6 (FIG. 3(*c*)) or has many small through-holes 7, 7, 7 . . . (FIG. 3(*d*)) formed therein in order to increase the contact area between the low-melting-point metal piece 3 and the connection section 1. Obviously, means for increasing the contact area between both members 1 and 3 is not limited to the above uneven processing 6 and the processing of the small holes 7, and any other means may be employed. In this case, the increase in the contact area between the connection section 1 and the low-melting-point metal piece 3 further lowers the melting point of the fused section 2 and increases the resistance thereof when an overcurrent flows through the blade fuse 10, enabling an electric circuit to be interrupted more promptly.

<Effect of Blade Fuse of the Present Invention>

Next, effects of the present invention will be described below with reference to FIGS. 4 to 8.

Figure 4B:
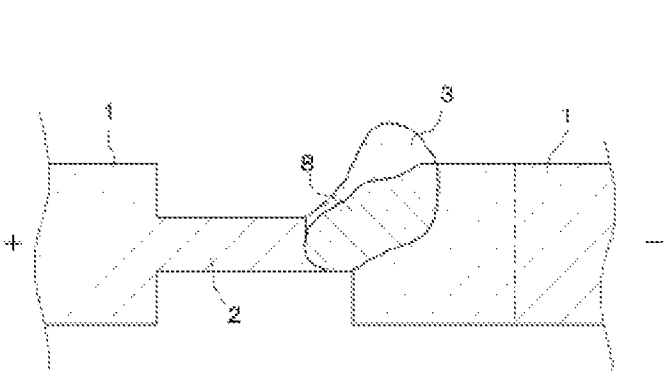
FIGS. 4(*a*) to 4(*c*) are cross-sectional views used to explain effects of the blade fuse of the present invention and schematic views illustrating the behavior of the low-melting-point metal piece.
Figure 4A:
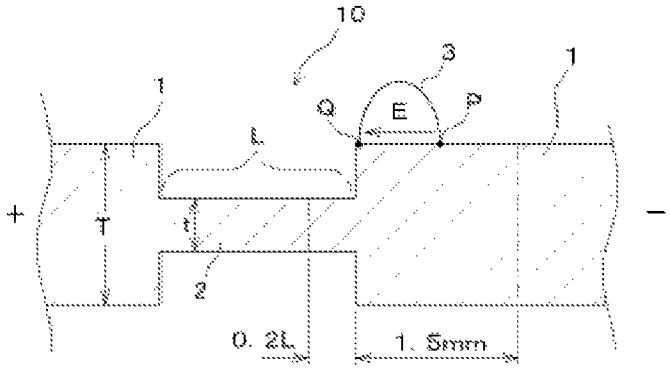
Figure 4C:
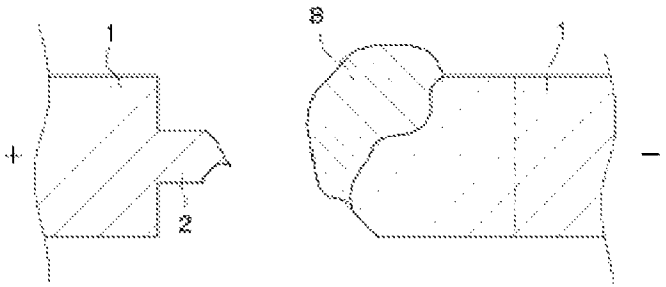

FIG. 4 are vertical cross-sectional views of the narrow section and its surrounding area, which are used to explain effects of the blade fuse of the present invention.

FIG. 4(*a*) illustrates the tin piece (low-melting-point metal piece) 3 melted and stuck to a surface of the connection section 1 in inverted bowl form through the fabricating method described above. In this example, positive and negative poles are on the left and right sides, respectively, of the fused section 2 in the drawing. The tin piece 3 is melted and stuck to one surface of the connection section 1 outside the fused section 2 made of zinc or a zinc alloy and at a site that does not partially traverse an edge of the fused section 2.

In the above case, when a current flows through the blade fuse 10 and the temperature of the tin piece 3 thereby reaches its low melting point, the so-called electromigration phenomenon occurs. More specifically, electrons E travel in the direction from "−" to "+" in the drawing. In response, zinc metal particles are diffused into tin, and the diffused zinc metal particles travel from the point P to the point Q.

As illustrated in FIG. 4(*b*), tin is melted and dispersed to enter the connection section 1 made of zinc. As a result, an alloy layer 8 that has a lower melting point than the original connection section 1 is formed.

Basically, the fused section 2, or the narrow section, has a high current density, and the alloy layer 8 has a low melting point. Therefore, as illustrated FIG. 4(*c*), while the alloy layer 8 is growing, a part of the fused section 2 close to the tin piece 3 (in the vicinity of the point Q in the original tin piece 3 in FIG. 4(*a*)) is selectively broken and separated promptly.

Figure 5A:
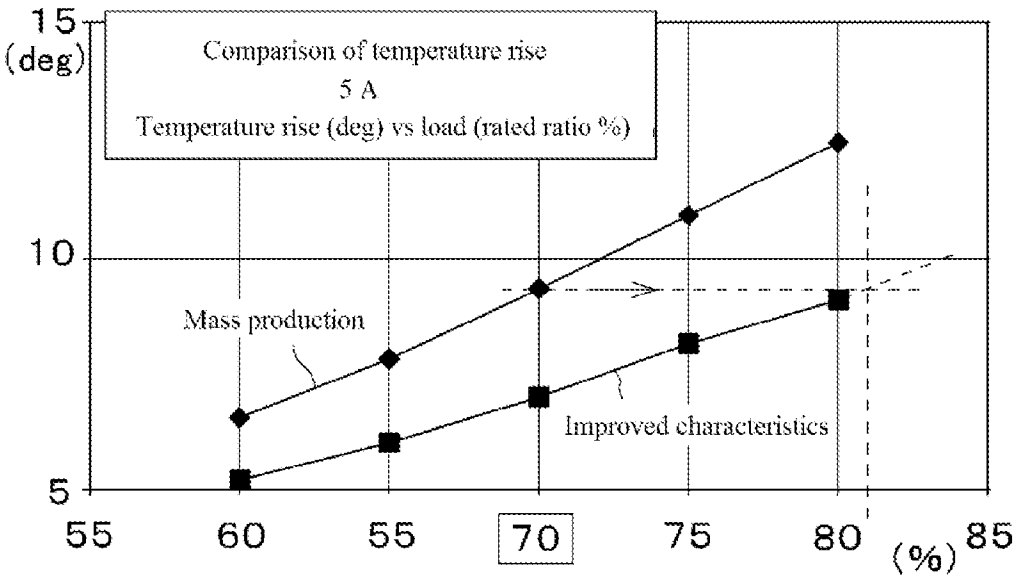
FIGS. 5(*a*) to 5(*c*) are graphs showing the comparison between the transitions of the temperature rises of blade fuses of the present invention and mass production, which are used to evaluate an effect of decreasing the temperature of the blade fuse of the present invention used within a safe current feeding region in which the rated ratio is about 70%.
Figure 5B:
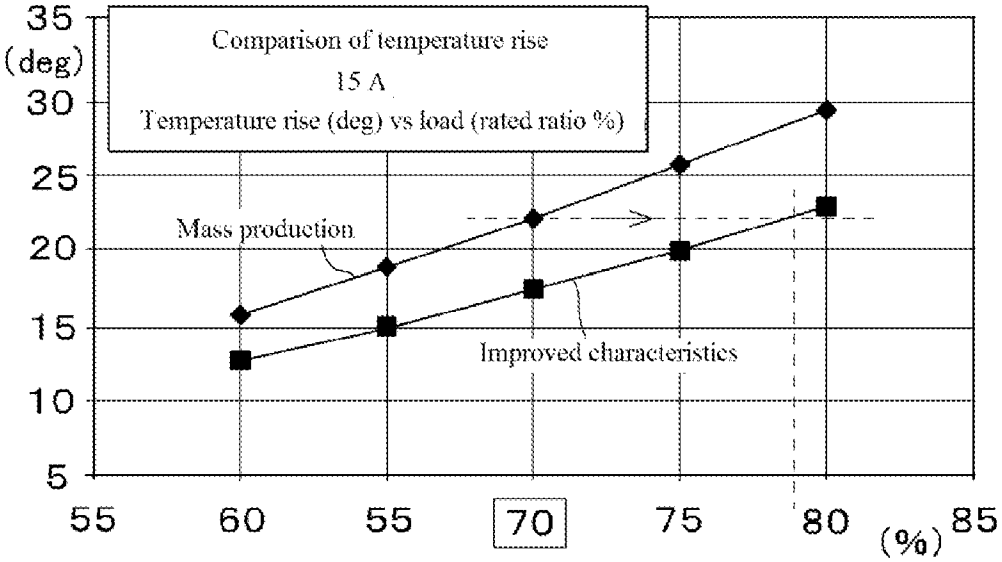
Figure 5C:
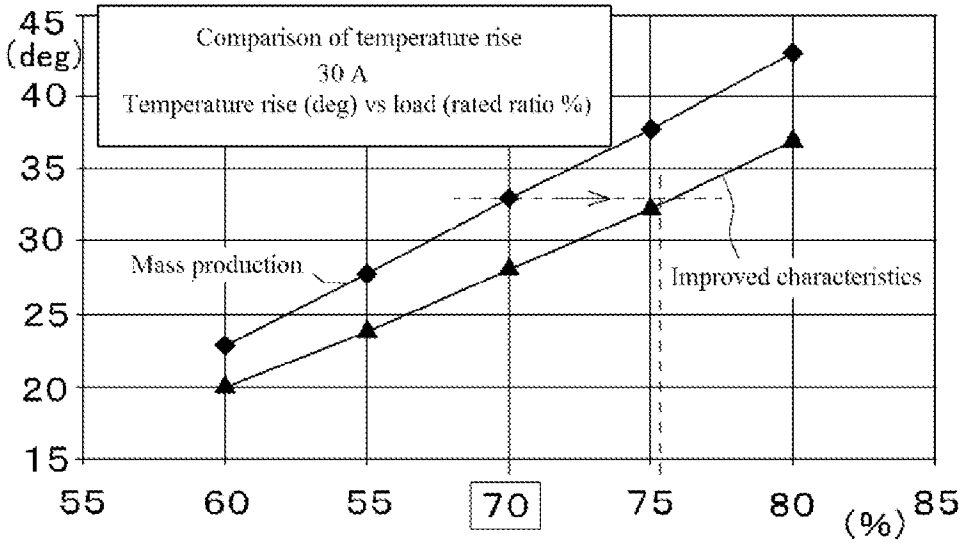

FIG. 5 are graphs showing the comparison between the transitions of the temperature rises of a blade fuse of the present invention and of a blade fuse of mass production (a blade fuse different from the blade of the invention). The blade fuses of each of the present invention and mass production have rated currents of 5 A, 15 A, and 30 A. These graphs are used to evaluate the effect of decreasing the temperatures of the blade fuses of the present invention when these blade fuses are used within a safe current feeding region in which a rated ratio is about 70%.

FIG. 5(*a*) shows the temperature rise curves of the blade fuses having a rated current of 5 A, FIG. 5(*b*) shows the temperature rise curves of the blade fuses having a rated current of 15 A, and FIG. 5(*c*) shows the temperature rise curves of the blade fuses having a rated current of 30 A. In each drawing, the lateral axis represents a rated current ratio (%) and the vertical axis represents a measured, elevated temperature (° C.) of the terminal section. The temperature rise curves indicated by "improved characteristics" are those of the blade fuses employing the present invention, and the temperature curves indicated by "mass production" are hose of the existing blade fuses that do not employ the present invention.

According to the result in FIG. 5(*a*), the blade fuse of mass production exhibits a temperature rise of "9.2° C." in a current feeding proportion in which a rated current ratio is 70%. In contrast, at "9.2° C." that is identical in temperature rise level to the blade fuse of the mass production, the blade fuse of the present invention can feed a current at a rated current ratio of up to "81%." This means that a current that is close to its rated current, or 5 A, can continuously flow through the blade fuse of the present invention while the temperature of the blade fuse is kept low. Furthermore, according to the graph, the temperature rise of the blade fuse of the present invention is "7° C." in a current feeding proportion in which a rated current ratio is 70%. The blade fuse of the present invention is thus effective in making its temperature 2.2° C. (=9.2° C.-7° C.) lower than that of the blade fuse of mass production when a current flows through it. This means that this temperature fall improves the durability of the blade fuse of the present invention.

The above elevated temperatures do not reveal the effect of decreasing heat emitted only from the fuses. The temperature at a measurement point is also elevated by heat from a wire. Specifically, when a heavy load is placed on the wire, the wire emits a large amount of heat. If the amount of heat emitted from the wire is considered, the accrual effect of the fuse is further enhanced by 10%, namely, totally enhanced by 21% (81%−70%+10%=21%).

The 15 A fuse in FIG. 5(*b*) and the 30 A fuse in FIG. 5(*c*) also show similar tendencies. The respective blade fuses of the present invention produce the effects of decreasing their temperatures by 5° C. (22° C.−17° C.) and 4.6° C. (32.8° C.−28.2° C.) in a current feeding proportion in which a rated current ratio is 70%.

Figure 6A:
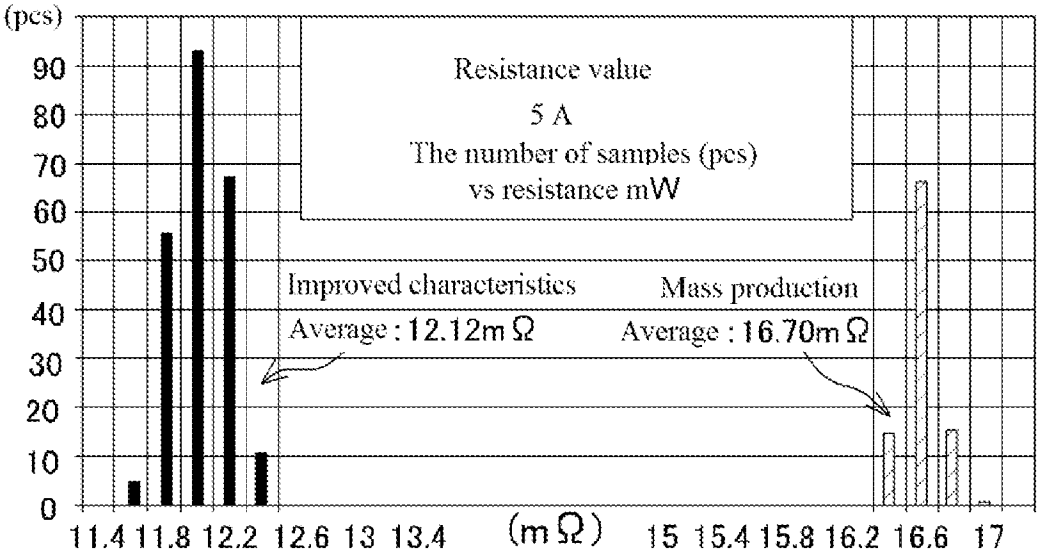
FIG. 6(*a*) is a table of the comparison between the resistances of blade fuses of the present invention and mass production, both of which have a rated current of 5 A.
Figure 6B:
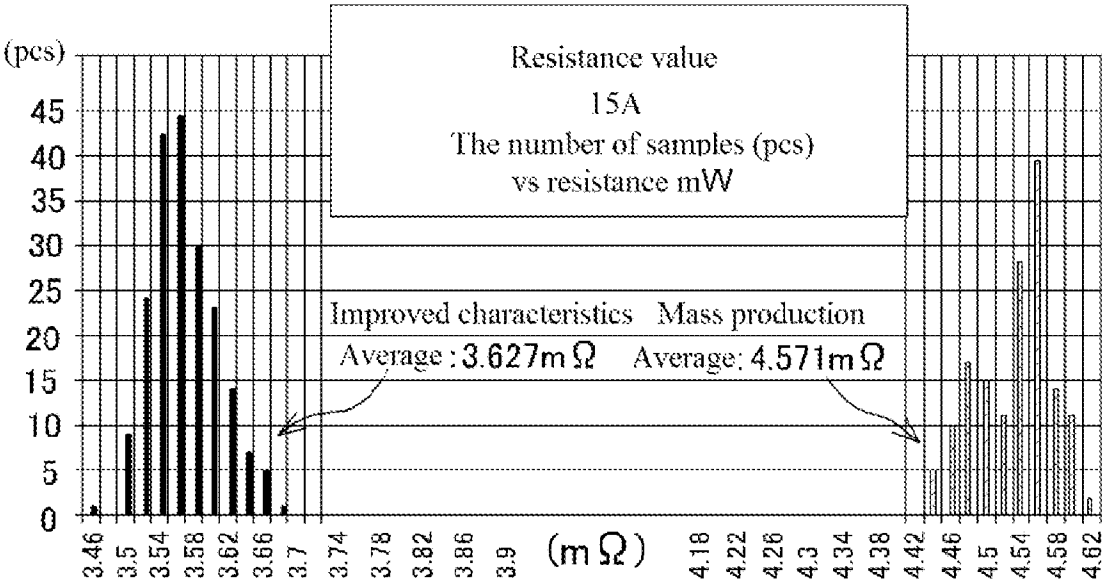
Figure 6C:
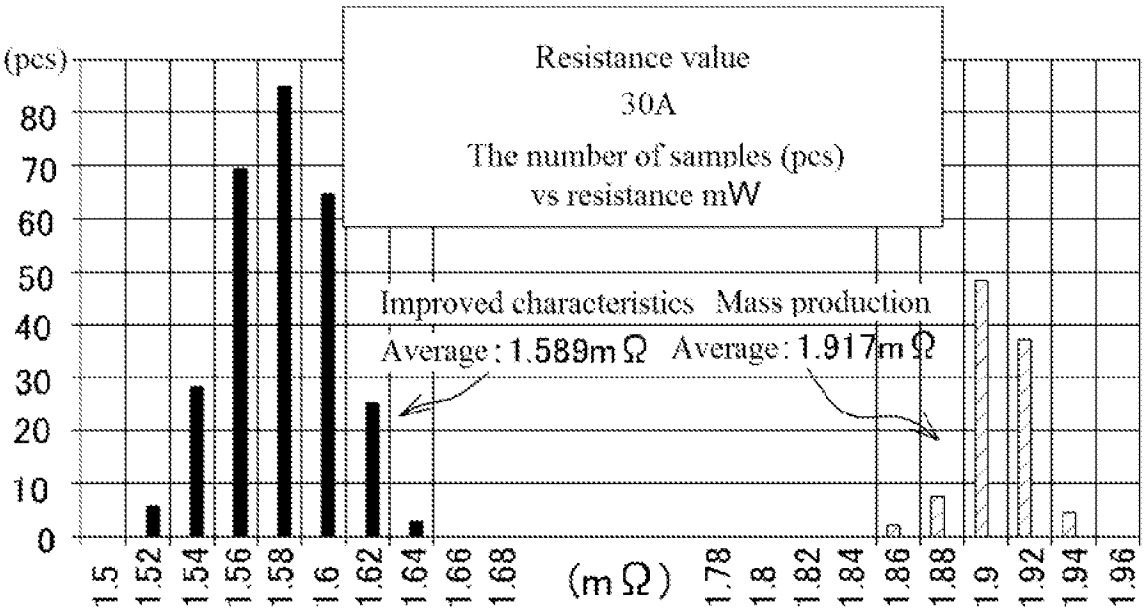

FIG. 6 shows the change in the measured resistance values of blade uses of the present invention and mass production under the same condition as the above. The blade fuses of each of the present invention and mass production have rated currents of 5 A, 15 A, and 30 A. The lateral axis represents a resistance value (mΩ), and the vertical axis represents the distribution of the number of samples which is checked at each resistance value.

According to the result in FIG. 6(*a*), the blade fuse of mass production exhibits an average resistance value of "16.7 mΩ," and the blade fuse of the present invention exhibits an average resistance value of "12.12 mΩ." Thus, the resistance value of the blade fuse of the present invention is 4.58 mΩ (=16.7 mΩ−12.12 mΩ) lower than that of the blade fuse of mass production. This decrease in the average resistance value indicates that the resistance and voltage drop of the blade fuse of the present invention is about 20% lower. This means that the decrease in the average resistance value results in the decrease in the power loss of the blade fuse of the present invention. The blade fuse of the present invention is thus highly effective in saving the electric power when used for in-vehicle applications in which many fuses are arranged.

The 15 A fuse in FIG. 6(*b*) and the 30 A fuse in FIG. 6(*c*) also show similar tendencies. As is evident from them, both resistance values decrease.

Figure 7:
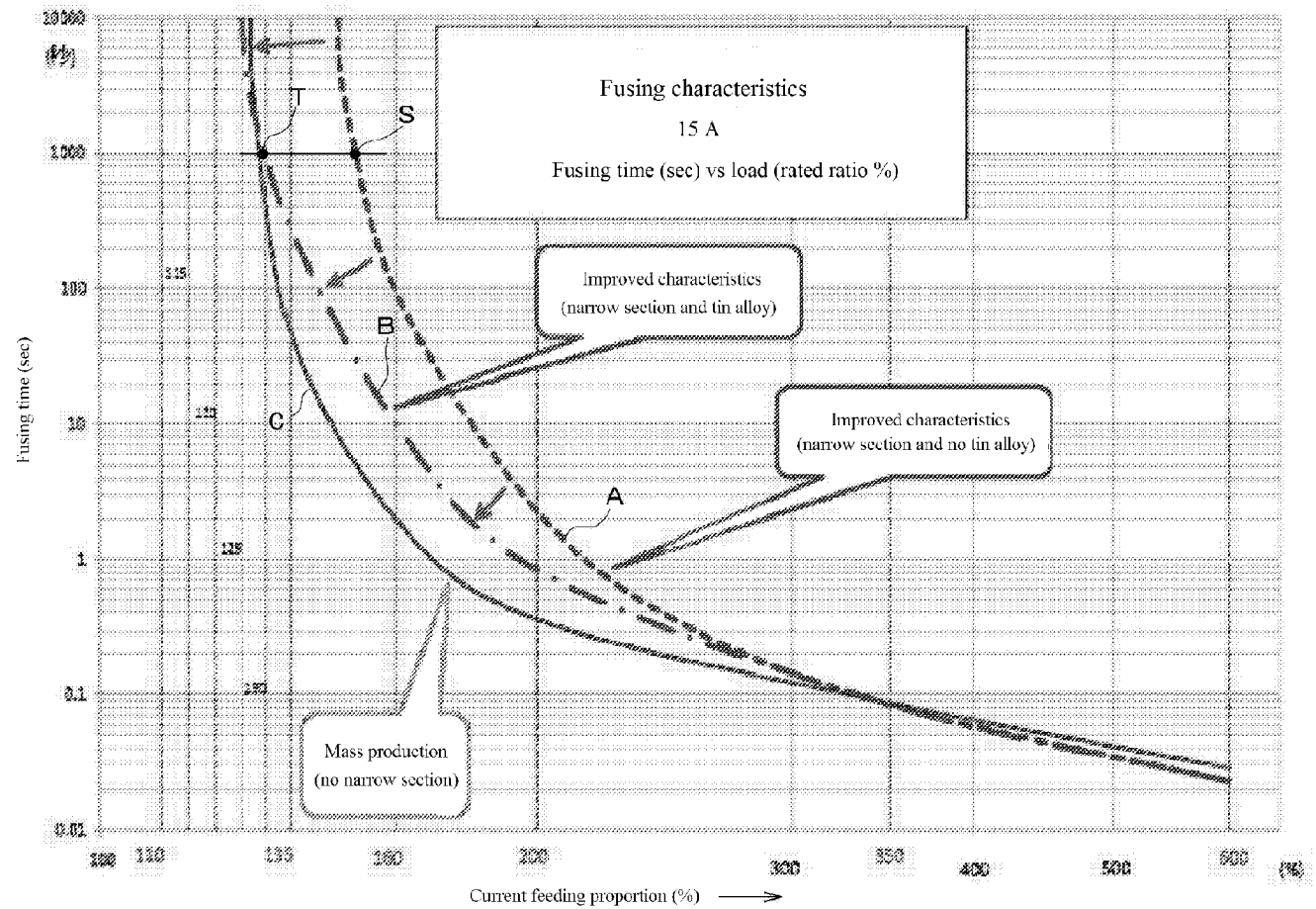
FIG. 7 is a fusing characteristic view of three blade fuses having a rated current of 15 A.

FIG. 7 is a fusing characteristic view of three blade fuses having a rated current of 15 A.

In the drawing, the lateral axis represents a current feeding proportion (%), and the vertical axis represents a fusing time (sec). In the drawing, the curve A corresponds to a blade fuse with improved characteristics which has a narrow section on which no tin alloy having a low melting point is stuck. The curve B corresponds to a blade fuse with improved characteristics according to the present invention which has a narrow section on which a tin alloy having a low melting point is stuck. The curve C corresponds to a blade fuse of mass production that has no narrow section.

The fusing curve B for the blade fuse of the present invention is displaced from the curve A to a low current feeding region as indicated by the arrow. At the same fusing time within current feeding proportion region, the blade fuse of the curve B blows in a lower current feeding proportion than those of the curves A and C. This reveals that the blade fuse of the curve B has a lower temperature when a current flows through it, thereby exhibiting higher durability. For example, at the same fusing time of 1000 seconds, the blade fuse of the curve A exhibits a current feeding proportion of 152% (point S), whereas the blade fuse with improved characteristics according to the present invention of the curve B exhibits a current feeding proportion of 128% (point T). Thus, the blade fuse of the curve B blows in 24% (152%−128%=24%) lower current feeding proportion, namely, at a correspondingly lower temperature.

For a fuse having a fuse rating of 5 to 30 A, its non-fusing current decreases by 10.3 to 16.6%. In other words, its rated current decreases by 14.3 to 24.9% (19.7% on average)

Example 2

Figure 8B:
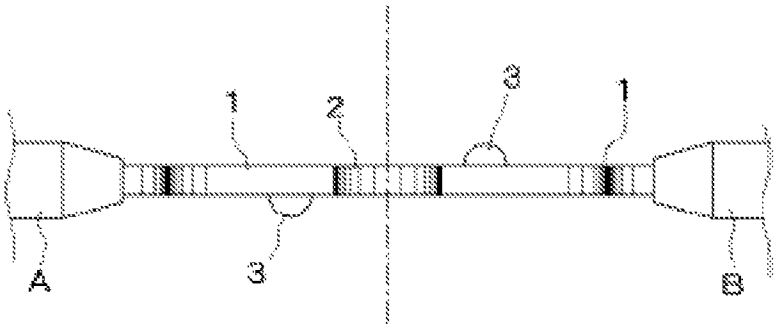
FIG. 8(*a*) is a plan view of a blade fuse according to the second invention described above.
Figure 8A:
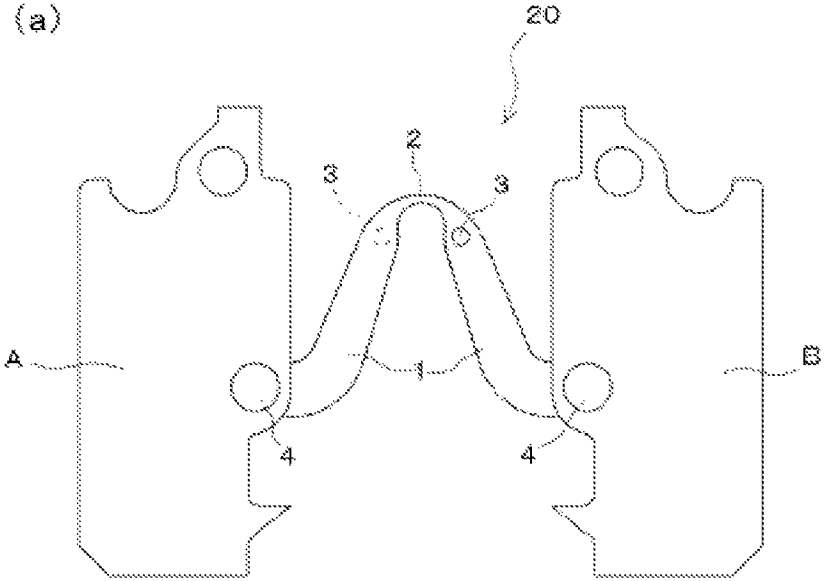

FIG. 8(*a*) is a plan view of a blade fuse 20 according to the second invention described above. FIG. 8(*b*) is a side view of the blade fuse 20 in FIG. 8(*a*).

As illustrated in those drawings, the blade fuse 20 of this embodiment has another low-melting-point metal piece 3, made of tin, melted and stuck on the rear surface of the connection section 1 at a substantially symmetric site with respect to the center of a fused section 2. The site at which tin is stuck on the rear surface of the connection section 1, the size of tin, the method of melting and sticking, and the like will not be described, because they conform to the embodiment 1.

FIG. 9 is a table showing an effect of the blade fuse according to embodiment 2.

In the table, the vertical axis indicates nine current feeding proportions in which rated current ratios are 116 to 135%, as loads including a non-fusing current region. The lateral axis indicates the maximum (MAX), minimum (MIN), and average (AVE) of the measurements of five samples of the blade fuse in FIG. 8 for each current feeding proportion in the vertical axis, when a terminal section A is set to a positive pole. Likewise, the lateral axis indicates the maximum (MAX), minimum (MIN), and average (AVE) of the measurements of the samples when a terminal section B is set to a positive pole.

According to the table, the average fusing times for the respective loads in the vertical axis when the terminal section A is set to the positive pole (FIG. 1) are shorter than that when the terminal section B is set to the positive pole. In addition, their non-fusing currents (that do not cause the fuse to blow over 500 hours) are about 4% ([116/120]×100≈96%) smaller. It can be found from the above that the migration effect becomes more significant when the fused section 2 has a positive pole (i.e., tin as a negative pole) in FIG. 8.

The above measurement results reveal that if a plate fuse is used within a low region in which a rated current is 5 or 7.5 A, its low-melting-point metal pieces 3, made of tin, are preferably melted and stuck on the front and rear surfaces of the connection section 1 while being positioned substantially symmetrically with respect to the center of the fused section 2, as illustrated in FIG. 8. This can reduce a variation in the migration effect.

The blade fuse 10 in the embodiment 1 and the blade fuse 20 in the embodiment 2 are simply exemplary. A blade fuse of the present invention is not limited to these and can undergo other modifications and combinations without departing from the spirit of the invention. Such modifications and exemplary combinations should be included within the scope of the invention.

INDUSTRIAL APPLICABILITY

Applications of a blade element according to the present invention are not limited to in-vehicle fuses. This blade fuse is applicable to fuses for various uses, and obviously such fuses should also be included within the technical scope of the invention.

The invention claimed is:

1. A blade fuse comprising:

a pair of terminal sections positioned at both ends of the blade fuse;

a connection section formed of a fusible metal body positioned between and connecting the terminal sections;

a fused section formed in a central section of the connection section, the fused section being smaller in cross section than other portions of the connection section, and a first and second low-melting-point metal pieces, each having an outer size identical or similar to the width of the connection section, the first low-melting-point metal piece is deposited on the front surface of the connection section such that the first low-melting-point metal piece partially traverses an edge of the fused section or is adjacent to an edge of the fused section but does not traverse to the edge of the fused section, and the second low-melting-point metal piece is deposited on a rear surface of the connection section such that the second low-melting-point metal piece partially traverses an edge of the fused section or is adjacent to an edge of the fused section but does not traverse to the edge of the fused section, wherein:

the terminal sections and the connection section are made of the same metal base material that is zinc or a zinc alloy, and the first and second low-melting point pieces are located at symmetrical positions on the blade fuse with respect to the center of the fused section.

2. The blade fuse according to claim 1, wherein the blade fuse is an automobile blade fuse configured for an in-vehicle application.

3. The blade fuse according to claim 1, wherein a first terminal section is a positive side and a second terminal section is a negative side, the second terminal having the first or second low-melting-point metal piece in a dome-shaped form positioned adjacent to the fused section.

4. A blade fuse comprising:

a pair of terminal sections positioned at both ends of the blade fuse;

a connection section formed of a fusible metal body positioned between and connecting the terminal sections;

a fused section formed in a central section of the connection section, the fused section having a long hole that decreases the cross section of the central section of the connection section relative to other portions of the connection section, and a first and second low-meting-point metal pieces, each having an outer size identical or similar to the width of the connection section, the first low-melting-point metal piece deposited on the front surface of the connection section outside the fused section such that the first low-melting-point metal piece partially traverses an edge of the fused section or is adjacent to an edge of the fused section but does not traverse to the edge of the fused section, and the second low-melting-point metal piece is deposited on a rear surface of the connection section such that the second low-melting-point metal piece partially traverses an edge of the fused section or is adjacent to an edge of the fused section but does not traverse to the edge of the fused section, wherein:

the terminal sections and the connection section are made of the same metal base material that is zinc or a zinc alloy, and the first and second low-melting point nieces are located at symmetrical positions on the blade fuse with respect to the center of the fused section.

5. The blade fuse according to claim 4, wherein the blade fuse is an automobile blade fuse configured for an in-vehicle application.

6. The blade fuse according to claim 4, wherein a first terminal section is a positive side and a second terminal section is a negative side, the second terminal having the first or second low-melting-point metal piece in a dome-shaped form positioned adjacent to the fused section.

* * * * *